US006364455B1

(12) United States Patent
Yang et al.

(10) Patent No.: US 6,364,455 B1
(45) Date of Patent: Apr. 2, 2002

(54) PRINTHEAD OF INK JET PRINTING APPARATUS AND MANUFACTURING METHOD THEREFOR

(75) Inventors: Ming-hsun Yang; Ji-Chen Wu; Arnold Chang-mou Yang; Chen-hua Lin, all of Hsinchu (TW)

(73) Assignee: Wisertek International Corporation, Hsinchi (TW)

( * ) Notice: Subject to any disclaimer, the term of this patent is extended or adjusted under 35 U.S.C. 154(b) by 0 days.

(21) Appl. No.: 09/401,264

(22) Filed: Sep. 23, 1999

(30) Foreign Application Priority Data

Jun. 29, 1999 (TW) ..... 88111134

(51) Int. Cl.[7] ..... B41J 2/14
(52) U.S. Cl. ..... 347/47; 347/63; 347/56
(58) Field of Search ..... 347/47, 63, 56; 430/320

(56) References Cited

U.S. PATENT DOCUMENTS 5,478,606 A * 12/1995 Ohkuma et al. ..... 430/320
5,524,784 A * 6/1996 Shiba et al. ..... 430/320
5,537,133 A * 7/1996 Marler et al. ..... 347/63
5,980,026 A * 11/1999 Imamura et al. ..... 347/65

* cited by examiner

*Primary Examiner*—John Barlow
*Assistant Examiner*—Manish S. Shah
(74) *Attorney, Agent, or Firm*—Bacon & Thomas

(57) ABSTRACT

A method in accordance with present invention comprises the steps of: forming a micro-control apparatus having a plurality of ejecting elements; forming a first layer of film on said micro-control apparatus and forming a plurality of ink chambers in the first layer of film; forming a second layer of photosensitive film on said first layer of film and forming an ink orifice in said second layer of photosensitive film relative to each of said plurality of ink chambers in the first layer of film by photolithography. The method for manufacturing the printhead in accordance with the present invention is relatively simple. Using this method, the application of a nozzle plate to a dry film photoresist and the precision alignment between ink orifices and ink chambers in manufacturing a conventional printhead can be avoided so that the throughput and yield rate can be increased.

9 Claims, 4 Drawing Sheets

PRINTHEAD OF INK JET PRINTING APPARATUS AND MANUFACTURING METHOD THEREFOR

FIELD OF THE INVENTION

The present invention relates to a printhead of an ink jet printing apparatus and its manufacturing method and, more particularly, to a printhead and its manufacturing method of forming ink orifices on a film by photolithography (exposure and development).

BACKGROUND OF THE INVENTION

In a conventional thermal bubble printhead, a high temperature is generated by a heating element so that a bubble is generated in the ink within the ink chamber on the heating element. The ink is ejected through an ink orifice by the pressure of the bubble and a dot of ink is printed onto a substrate (such as a sheet of paper). However, to let the bubbles generated by heating adequately eject the ink and form a dot of ink, the ink has to be confined in the ink chamber of the printhead, and has to be ejected through a predetermined ink orifice.

A piezoelectric printhead utilizes a piezoelectric material to eject the ink by deforming a film through changing the voltage of an electrode so that the ink is ejected by the film and a dot of ink is printed onto a predetermined substrate through an ink orifice.

The print cartridge of a conventional bubble-type ink jet printing apparatus is shown in FIG. 1. It comprises an ink reservoir 10 and a printhead 12. The ink in the ink reservoir 10 flows through the printhead 12 and is ejected by the printhead 12 onto a substrate. FIG. 2 illustrates the structure of the printhead 12. The printhead 12 comprises a micro-control apparatus 16 formed with a plurality of ejecting elements (i.e. heating elements 14 in accordance with the preferred embodiment of the invention). A photosensitive film (dry film photoresist) 18 is formed on the micro-control apparatus 16. The photosensitive film 18 is used to form ink chambers 20 at locations in alignment with the heating elements 14 by photolithography (exposure and development) so that the ink can flow into the ink chambers 20. The ink orifices 22 is formed in a nozzle plate 24 by electrical forming and the nozzle plate 24 is applied to the dry film photoresist 18 by a way of precision alignment. Therefore, in the assembling process, the ink orifices 22 in the nozzle plate 24 must be in precision alignment with the ink chambers 20 in the photosensitive film 18 respectively so that the ink heated by the heating elements 14 can be ejected through the ink orifices 22. It can be known that this manufacturing process incurs high costs including the tool cost for precision alignment and low quality alignment, assembling, or application of the nozzle plate 24 to the dry film photoresist 18 reduces the yield rate.

Another printhead of a bubble-type ink jet printing apparatus is disclosed in U.S. Pat. No. 5,537,133 and is illustrated in FIG. 3. The printhead 30 comprises a micro-control apparatus 34 formed with a plurality of ejecting elements (i.e. heating elements 32 in accordance with the preferred embodiment of the invention). A photosensitive film (dry film photoresist) 35 is formed on the micro-control apparatus 34. An ink chamber 36 is formed on each heating element 32 by photolithography (exposure and development). Ink orifices 39 are formed in a tape (flexible circuit board) 38, which is attached to the printhead 30 by Tape Automated Bonding (TAB), by laser ablating and the tape 38 is applied to the micro-control apparatus 34 in a way of precision alignment so that each ink orifice 39 and a corresponding ink chamber 36 cooperatively form an ink reservoir for the ink. However, forming ink orifices 39 in tape 38 by laser ablating incurs a high equipment cost that significantly increases the manufacturing cost of the printhead. In addition, low quality alignment and assembling may also reduce the yield rate.

SUMMARY OF THE INVENTION

A primary object of the invention is to provide a printhead and the manufacturing method therefor so that the process of manufacturing a printhead can be simplified, the equipment cost can be reduced, and the yield can be increased.

Another object of the invention is to provide a printhead and the manufacturing method therefor that features the efficacy of precision alignment and high quality assembling so that the yield can be increased and the manufacturing process can be simplified.

To achieve the above-mentioned objects, the manufacturing method in accordance with present invention is characterized in that it comprises the steps of: forming a micro-control apparatus having a plurality of ejecting elements; form a first layer of film on the micro-control apparatus, a ink chamber being formed in the first layer of film in alignment with each ejecting element; forming a second layer of film on the first layer of film; and forming ink orifices in the second layer film in alignment with the ink chambers in the first layer film respectively by photolithography(exposure and development).

Therefore, the manufacturing process of the printhead in accordance with the present invention is relatively simple. Using this process, the application of a nozzle plate to a dry film photoresist and the precision alignment between ink orifices and ink chambers in manufacturing a conventional printhead can be avoided so that the throughput and yield rate can be increased.

A printhead of an ink jet printing apparatus in accordance with the present invention is characterized in that it comprises a micro-control apparatus formed with a plurality of ejecting elements; a first layer of film formed on the micro-control apparatus, an ink chamber being formed in the first layer of film relative to each of the ejecting elements; a second layer of film formed on the first layer of film, an ink orifice being formed in the second layer of film relative to each ink chamber in the first layer of film by photolithography(exposure and development). Therefore, in manufacturing the printhead in accordance with the invention, there is no need to form ink orifices by electrical forming or laser ablating and precision alignment can be achieved when forming ink orifice by photolithography (exposure and development). Thereby, the manufacturing process of a printhead can be simplified, the quality of precision alignment can be improved, and the yield can be increased.

BRIEF DESCRIPTION OF THE DRAWINGS

The present invention can be further understood by reference to the following description taken in conjunction with the accompanying drawings wherein.

DETAILED DESCRIPTION OF THE PREFERRED EMBODIMENTS

Figure 1:
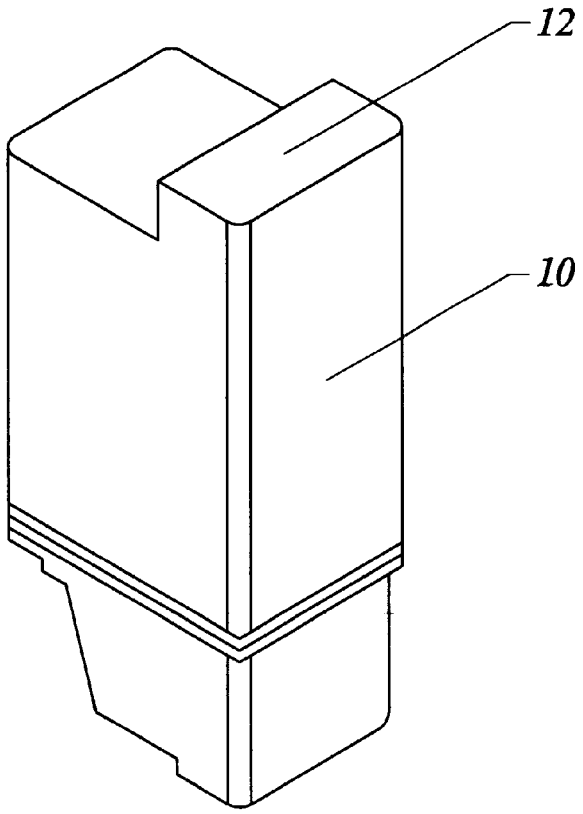
FIG. 1 (PRIOR ART)
FIG. 1 is a pictorial view showing the print cartridge structure of a conventional printer.
Figure 2:
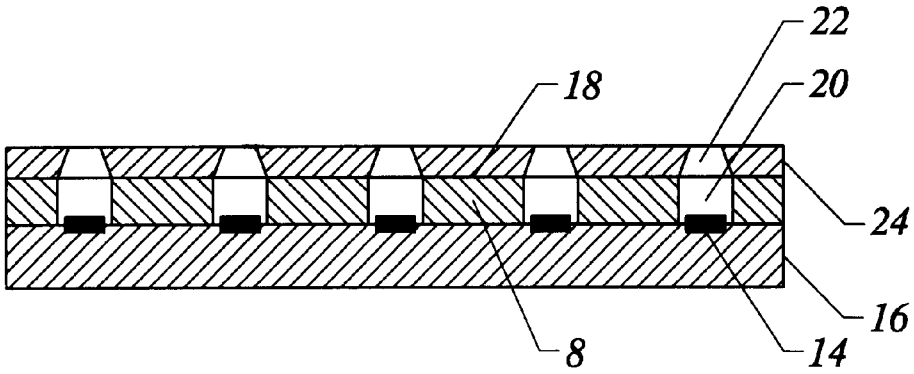
FIG. 2 (PRIOR ART)
FIG. 2 is an enlarged sectional view of the printhead as shown in FIG. 1.
Figure 3:
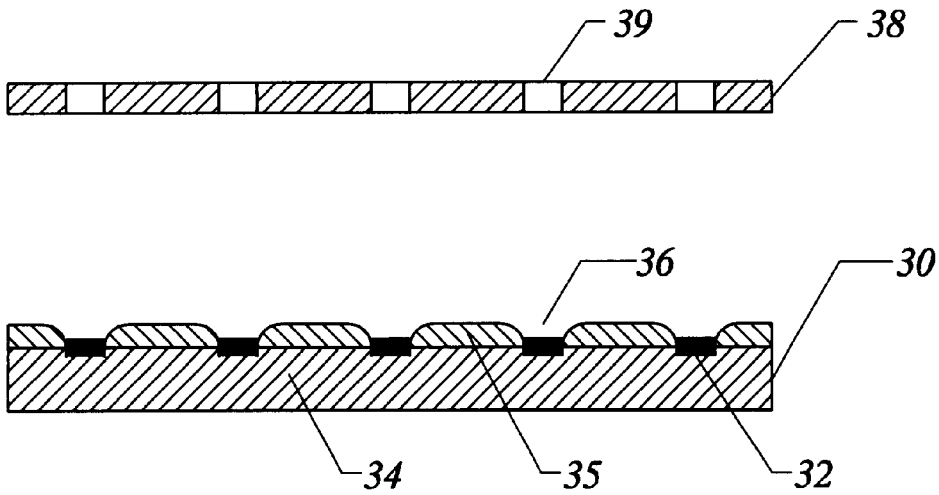
FIG. 3 (PRIOR ART)
FIG. 3 is an enlarged sectional view of another conventional printhead.
Figure 4:
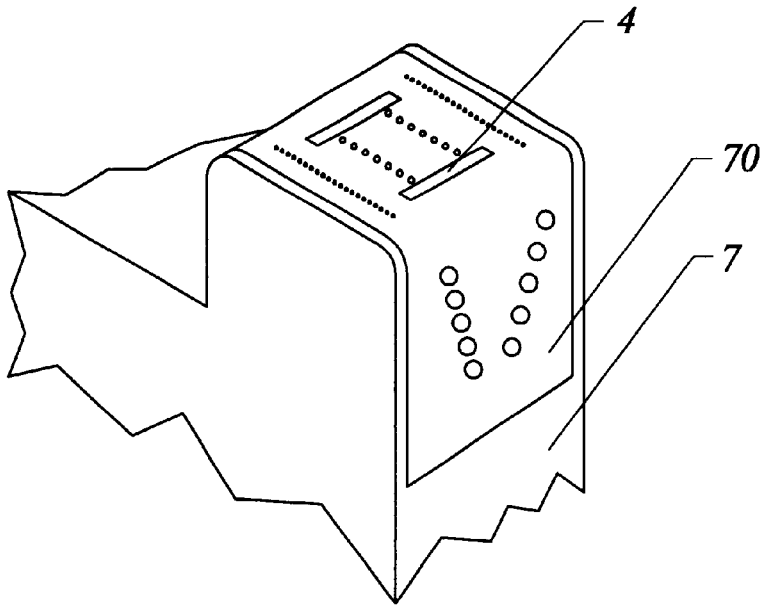
FIG. 4 illustrates a printhead of an ink jet printing apparatus in accordance with a preferred embodiment of the present invention.

Referring to FIG. 4 that illustrates a preferred embodiment of the present invention, a printhead 4 provided at one end of a print cartridge 7 comprises a signal input means (flexible circuit board) 70. One end of the signal input means 70 is connected to the signal output terminal of the printer and the other end is connected to a micro-control apparatus (i.e. an IC chip in accordance with the preferred embodiment of the invention) so that printer signals can be transmitted to a micro-control apparatus of the printhead 4 to activate the printhead 4. This is well known and will not be further described.

Figure 5:
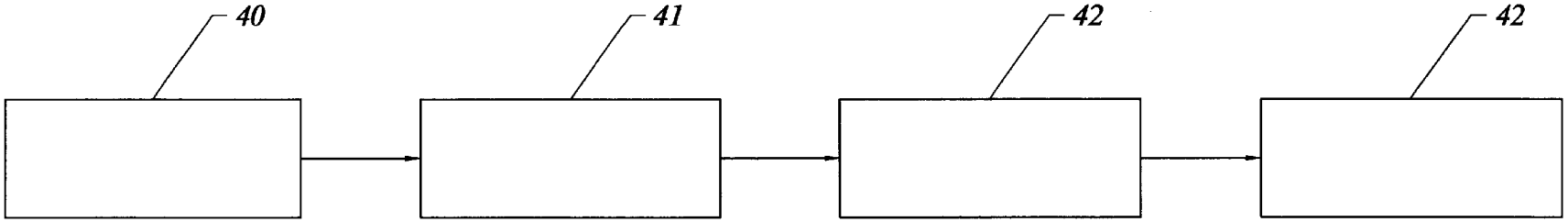
FIG. 5 is a flow diagram showing the manufacturing process of a printhead of an ink jet printing apparatus in accordance with a preferred embodiment of the present invention.
Figure 6:
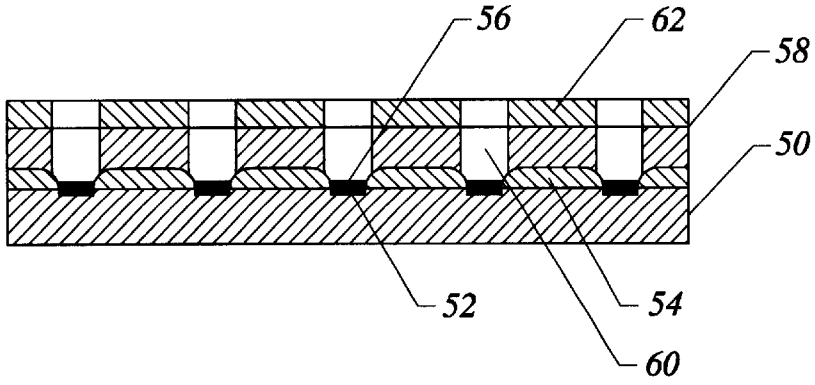
FIG. 6 is an enlarged sectional view of a printhead of an ink jet printing apparatus in accordance with a preferred embodiment of the present invention.

Referring to FIGS. 5 and 6, the first step 40 is to form an electronic circuit on a substrate by a semiconductor manufacturing process and this results in a micro-control apparatus 50 that is formed with a plurality of ejecting elements 52. An ejecting element can be a heating means for heating the ink to generate bubbles for ejecting the ink or can be a piezoelectric material in the form of a film that can be deformed by changing the voltage applied on an electrode and can apply pressure, when it is deformed, on the ink to eject the ink through a corresponding ink orifice. Therefore, a printer signal is transmitted by the signal input apparatus 70 to the micro-control apparatus 50 for controlling the ejecting element 52 to eject the ink.

The second step 41 is to form a first layer of film 54 on the micro-control apparatus 50 (i.e. an IC chip in accordance with the preferred embodiment of the invention). The first layer of film 54 is a photosensitive film having a thickness of about 40 to 50 $\mu$m. A concave ink chamber 56 is formed in the first layer of photosensitive film 54 in alignment with each ejecting element 52 by photolithography (exposure and development) so that the ink can flow through the ink chamber 56 and the ink in the ink chamber 56 can be ejected on to a predetermined substrate when a signal is transmitted to a corresponding ejecting element 52 by the electronic circuit of the IC chip 50.

The third step 42 is to form a second layer of photosensitive film 58 on the first layer of film 54 by photolithography (exposure and development) so that an ink orifice 60 is formed in the second layer of photosensitive film 58 relative to each ink chamber 56 of the first layer of film 54. Each ink chamber 56 and the corresponding ink orifice 60 form an ink reservoir for receiving the ink. Therefore, each ink orifice 60 formed by exposure and development is in precision alignment with a corresponding ink chamber 56 in the first layer of film 54. Thereby, the precision alignment between the ink chamber 56 and the corresponding ink orifice 60 in the assembling process can be simplified and this can increase the yield. Moreover, due to the simplification, the equipment costs incurred by electrical forming, laser ablating, and precision alignment can be saved to significantly reduce the manufacturing cost.

The fourth step 43 is to form a third layer of photosensitive film 62 on the second layer of photosensitive film 58 before forming ink orifices 60 by photolithography in order to protect the second layer of photosensitive film 58 Thereafter, ink orifices 60 are formed in the second layer of photosensitive film 58 and the third layer of photosensitive film 62 simultaneously by photolithography (exposure and development).

In the preferred embodiment, the first, second, and third layers of photosensitive film 54, 58, and 62 are made of dry film photoresist.

Referring to FIG. 6, the printhead of an ink jet printing apparatus in accordance with the present invention comprises a micro-control apparatus 50(i.e. an IC chip in accordance with the preferred embodiment of the invention) formed with a plurality of ejecting elements 52. The electronic circuit of the IC chip 50 controls the ejecting elements 52 to eject the ink through ink orifices 60.

The first layer of film 54 is made of a dry film photoresist having a thickness of about 30 to 40 $\mu$m and is formed on the micro-control apparatus 50. An ink chamber 56, in alignment with each ejecting element 52 of the micro-control apparatus 50, is formed in the first layer of film 54 for receiving the ink to be ejected.

The second layer of photosensitive film 58 is also made of a dry film photoresist having a thickness of about 30 to 40 $\mu$m and is formed on the first layer film 54. An ink orifice 60, in alignment with each ink chamber 56 in the first layer film 54, is formed in the second layer of photosensitive film 58 by photolithography (exposure and development).

Therefore, an ink chamber 56 in the first layer film 54 and a corresponding ink orifice 60 in the second layer photosensitive film 58 cooperatively form an ink reservoir so that a dot of ink can be ejected through ink orifice 60 onto a predetermined substrate when the ejecting element 52 applies a pressure on the ink within the ink reservoir.

In addition, a third, layer of photosensitive film 62 of high structural strength is optionally formed on the second layer of photosensitive film 58 to protect the second layer of photosensitive film 58. The ink orifices 60, in alignment with the ink chambers 56 in the first layer of film 54, can be formed simultaneously by photolithography (exposure and development) in the second and third layers of photosensitive film 58 and 62.

One end of the signal input means (flexible circuit board) 70 is connected to the signal output terminal of the printer and the other end is connected to a micro-control apparatus so that printer signals can be transmitted to a micro-control apparatus of the printhead 4 to activate the printhead.

Figure 7:
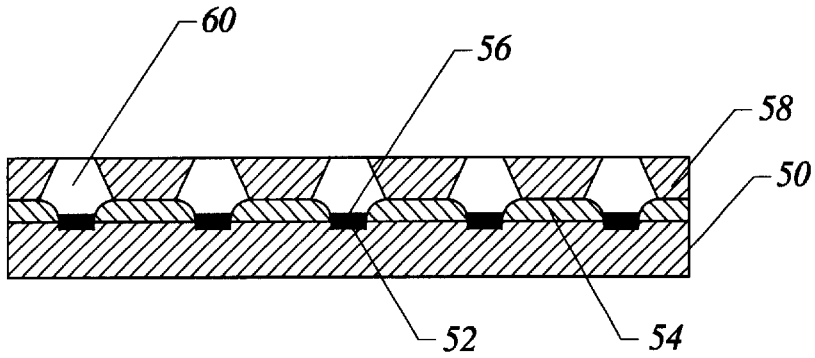
FIG. 7 is an enlarged sectional view of a printhead of an ink jet printing apparatus in accordance with another preferred embodiment of the present invention.

Referring to FIG. 7 that illustrates another preferred embodiment of the present invention, the second layer of photosensitive film 58 can be formed with tapered ink orifices 60 by two runs of photolithography (exposure and development) so that the ink in the ink chamber 56 can be ejected with a higher speed through the ink orifice 60.

Figure 8:
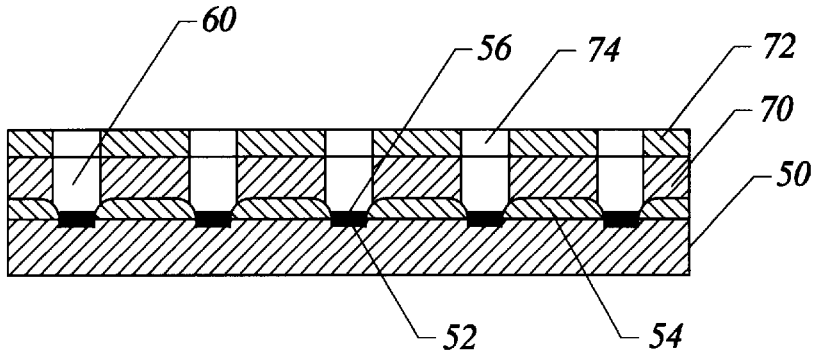
FIG. 8 is an enlarged sectional view of a printhead of an ink jet printing apparatus in accordance with yet another preferred embodiment of the present invention.

Referring to FIG. 8, the manufacturing method in accordance with another embodiment of the present invention comprises forming a micro-control apparatus 50(i.e. an IC chip in this embodiment) provided with a plurality of ejecting elements 52. A first layer of film 54 formed with a plurality of ink chambers is formed on the micro-control apparatus 50. A second layer film 70 is formed on the first layer film 54. A third layer of photosensitive film 72 is formed on the second layer film 70. Development orifices 74, in alignment with the ink chambers 56 in the first layer film 54, are formed in the third layer of photosensitive film 72 by photolithography (exposure and development) and ink orifices 76 are formed in the second layer film 70 via the development orifices 74 by dry etching. The micro-control apparatus 50 is connected to a signal input means so that a printer signal can be transmitted to an ejecting element of the micro-control apparatus 50 to eject the ink in the ink chamber 56 through the ink orifice 76. Finally, the third layer of photosensitive film 72 is removed.

Therefore, an ink chamber 56 in the first layer film 54 and an ink orifice 76 in the second layer film 70 form an integral ink reservoir. The ink in the ink reservoir is ejected through an ink orifice 76 in the second layer film 70 when an ejecting element 52 of m the micro-control apparatus 50 receives a signal so that a dot of ink is ejected onto a predetermined substrate.

It can be easily understood that forming ink orifices in accordance the manufacturing method of the present invention by photolithography (exposure and development) can avoid the precision alignment and forming of ink orifices by laser ablating or electrical forming in a conventional printhead manufacturing process. Therefore, the equipment cost can be significantly reduced. Furthermore, forming ink orifices by photolithography (exposure and development) in a dry film photoresist can achieve the precision alignment and this improves the yield rate.

Although the preferred embodiments of the invention have been illustrated and described, it will be obvious to those skilled in the art that various modifications may be made without departing from the scope and spirit of the invention defined by the appended claims.

What is claimed is:

1. A printhead of an ink jet printing apparatus comprising:

a micro-control apparatus formed with a plurality of ejecting elements;

a first layer of film formed over said micro-control apparatus, an ink chamber being formed in the first layer of film relative to each of said a plurality of ejecting elements;

a second layer of photosensitive film formed on said first layer of film, an ink orifice being formed in the second layer of film relative to said ink chamber in the first layer of film by photolithography (exposure and development);

a third layer of photosensitive film formed on said second layer of high-molecular photosensitive film for protecting said second layer of photosensitive film, an ink orifice being formed at the same time in said second layer and said third layer of photosensitive film relative to each of said plurality of ink chambers in the first layer of film by photolithography (exposure and development);

a signal input means, one end of the signal input means being connected to the signal output terminal of said printing apparatus and the other end being connected to said micro-control apparatus, thereby, said ink chamber in said first layer film and its corresponding ink orifice in the second layer of photosensitive film cooperatively form an ink reservoir and a dot of ink can be ejected from the ink reservoir by a corresponding one of said a plurality of ejecting element.

2. A printhead of an ink jet printing apparatus according to claim 1, wherein said first layer of film is a photosensitive film and said ink chamber is formed by photolithography (exposure and development).

3. A printhead of an inkjet printing apparatus according to claim 1, wherein said third layer of photosensitive film is stronger in structural strength than second layer of photosensitive film.

4. A printhead of an ink jet printing apparatus according to claim 3, wherein each of said first layer, said second layer, and said third layer of film is a dry film photoresist.

5. A printhead of an ink jet printing apparatus according to claim 1, wherein said ink orifice is formed in said second layer of photosensitive film by more than one photolithography (exposure and development) processes so that the diameter at an upper location of said ink orifice is smaller than that at a lower location.

6. A printhead of an ink jet printing apparatus comprising:

a micro-control apparatus formed with a plurality of ejecting elements;

a first layer of film formed on said micro-control apparatus, and in said first layer of film, an ink chamber is formed over each of said plurality of ejecting elements;

a second layer of film formed over said first layer of film;

a third layer of photosensitive film formed on said second layer of film, wherein a development orifice is formed in said third layer of photosensitive film relative to each of said plurality of ink chambers in the first layer of film by photolithography and an ink orifice is formed in said second layer of film by dry etching through said development orifice; and a signal input means connected to said micro-control apparatus in such way that one of said plurality of ejecting elements of said micro-control apparatus can be trigger by a signal from the printing apparatus to eject a dot of ink from a corresponding in chamber.

7. A printhead of an ink jet printing apparatus according to claim 6, wherein said plurality of ejecting elements of said micro-control apparatus comprise a plurality of heating elements and each of said plurality of heating elements can be activated to heat up the ink in its corresponding ink chamber and cause the ink vaporize and be ejected through its corresponding ink orifice in said second layer of photosensitive film.

8. A printhead of an ink jet printing apparatus according to claim 6, wherein each of said plurality of ejecting elements of said micro-control apparatus comprises a piezoelectric material in the form of a film that can be deformed by changing the voltage applied on an electrode and can apply pressure, when it is deformed, on the ink to eject the ink through a corresponding ink orifice.

9. A printhead of an ink jet printing apparatus according to claim 6, wherein said first layer of film is a photosensitive film and a plurality of ink chambers are formed in said photosensitive film by photolithography (exposure and development).

* * * * *